US008448612B2

(12) United States Patent
Wilson et al.

(10) Patent No.: US 8,448,612 B2
(45) Date of Patent: May 28, 2013

(54) COMBUSTION DEVICE TO PROVIDE A CONTROLLED HEAT FLUX ENVIRONMENT

(75) Inventors: Kenneth Jay Wilson, Ridgecrest, CA (US); Travis Shane Laker, Tremonton, UT (US); Ephraim Berk Washburn, Ridgecrest, CA (US); Alice Irene Atwood, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 1770 days.

(21) Appl. No.: 11/789,115

(22) Filed: Apr. 5, 2007

(65) Prior Publication Data

US 2012/0214105 A1 Aug. 23, 2012

(51) Int. Cl.
*F02B 45/08* (2006.01)

(52) U.S. Cl.
USPC ..... 123/3; 123/1 A

(58) Field of Classification Search
USPC ..... 123/3, 1 R, 1 A, 2
See application file for complete search history.

(56) References Cited

U.S. PATENT DOCUMENTS

| | | | | |
|---|---|---|---|---|
| 3,393,903 | A * | 7/1968 | Berglund, Jr. | 432/223 |
| 4,008,039 | A * | 2/1977 | Compton et al. | 431/90 |
| 4,244,349 | A * | 1/1981 | Velie et al. | 126/110 C |
| 4,483,474 | A * | 11/1984 | Nikolich | 227/8 |
| 4,522,162 | A * | 6/1985 | Nikolich | 123/46 SC |
| 5,259,755 | A * | 11/1993 | Irwin et al. | 431/9 |
| 5,511,970 | A * | 4/1996 | Irwin et al. | 431/9 |
| 5,865,618 | A * | 2/1999 | Hiebert | 432/222 |
| 6,142,141 | A * | 11/2000 | Long | 126/110 B |
| 6,857,570 | B2 * | 2/2005 | Tsikos et al. | 235/462.01 |
| 6,857,870 | B2 * | 2/2005 | Topp | 431/350 |
| 6,880,549 | B2 * | 4/2005 | Topp | 126/110 B |
| 2001/0051321 | A1 * | 12/2001 | La Fontaine | 431/12 |
| 2004/0084032 | A1 * | 5/2004 | Baasch et al. | 123/585 |
| 2006/0201406 | A1 * | 9/2006 | O'Connor | 110/346 |

* cited by examiner

*Primary Examiner* — Noah Kaman
*Assistant Examiner* — Long T Tran
(74) *Attorney, Agent, or Firm* — David S. Kalmbaugh; Christopher L. Blackburn

(57) ABSTRACT

A propane fueled combustor for providing a controlled heat flux environment of twenty to two hundred kilowatts per square meter. The combustor has the capability of generating a repeatable and quantifiable environment in which to evaluate a response of an energetic material to a fast cook off hazard, such as a liquid fuel fire.

17 Claims, 4 Drawing Sheets

COMBUSTION DEVICE TO PROVIDE A CONTROLLED HEAT FLUX ENVIRONMENT

BACKGROUND OF THE INVENTION

1. Field of the Invention

The present invention relates generally to hazards classification of energetic materials and other explosive ordinance. More particularly, the present invention relates to a propane fueled combustion device which provides a controlled heat flux environment for hazardous classification of an ordinance system.

2. Description of the Prior Art

In the United States, all ordnance must be hazard classified. Hazards classification of an energetic material (which are used in all ordnance systems) requires a number of tests to determine the type of reaction and level of reaction violence for various potential accident scenarios in transport and storage situations. These tests include shock initiation, sympathetic detonation, and external fuel-fires which are referred to as cook-off tests. Both shock initiation and sympathetic detonation tests have small-scale analog tests that allow for alternative options to expensive full-scale testing.

To date, no small-scale test has or exists or is under development for the external fuel-fire test required for classification of explosive ordnance. A test of this type can be very expensive for rocket motors greater than 11 inches in diameter as it requires the use of three full-sized, production assets or rocket motors in their shipping and storage configuration.

For a liquid fuel/external fire test, a rocket motor is exposed to a liquid fuel fire, which extends a maximum of one meter beyond the edge of the motor. There is also a requirement that the fuel burn for 150 percent of the time required to cause a reaction. The initial cost of the rocket motor, the potential hazards associated with conducting the test, and the amount of land required for a test site are some of the difficulties in performing an external fire test on a solid rocket motor.

For large-scale rocket motors, it is highly likely that performing a full-scale fuel-fire test will be cost prohibitive. Furthermore, the physical nature of a fuel-fire is very difficult to quantify and measure. Understanding how heat flux is coupled from the fuel-fire flames to a specific device, such as a large scale rocket motor is important to experimental and computational modeling efforts in this area.

Currently for hazard classification, the Department of Defense Explosives Safety Board mandates that full-scale external fuel fire tests are performed using a shallow pool of aircraft fuel (JP-5 or JP-8 jet fuel) and a minimal amount of instrumentation to determine the air temperature at several locations. This type of full-scale fuel fire testing is difficult to perform because it requires the use of a full-scale test specimen and large specialized facilities, both of which can be extremely expensive. The full-scale test is capable of providing the necessary thermal stimulus, but it lacks sufficient instrumentation to quantify the stimulus for use in present day computational models. Technology is not currently available to provide the necessary resolution of measured heat flux level or provides a sufficient level of control for the application of constant thermal boundary conditions into a small-scale/smaller than full-scale test specimen for the purpose of observing the resulting response of the energetic material. Accordingly, there is a need for a small-scale external fuel fire test apparatus for hazard classification and also to probe the underlying physical response of energetic materials to fast cook-off in a controlled manner.

SUMMARY OF THE INVENTION

The present invention comprises a controlled heat flux combustor which provides a controlled heat flux environment for hazardous classification of an ordinance system. A five horsepower fan motor delivers air through an air duct tube. The fan delivers air at a mass flow rate of approximately one pound/second. Propane fuel is introduced through an aluminum manifold located at the end of the tube via eight fuel injectors.

An array of eight injectors provides for uniform fuel distribution of a propane fuel. The fuel is mixed with air, which provides a flammable mixture. The fuel air mixture then expands into an 18 inch combustion chamber which is approximately six feet in length. This fuel air mixture is then ignited in the combustion chamber, at which time the fuel is consumed in a reaction region within the combustion chamber, generating high temperature gas products. The combustion chamber has an inside diameter that is larger than the air duct. The change in area from the smaller air duct to the larger combustion chamber allows flame stabilization for the reaction region. The amount of fuel and air introduced into the chamber controls the gas temperature and therefore the heat flux generated in the combustion chamber.

DETAILED DESCRIPTION OF A PREFERRED EMBODIMENT

Figure 1:
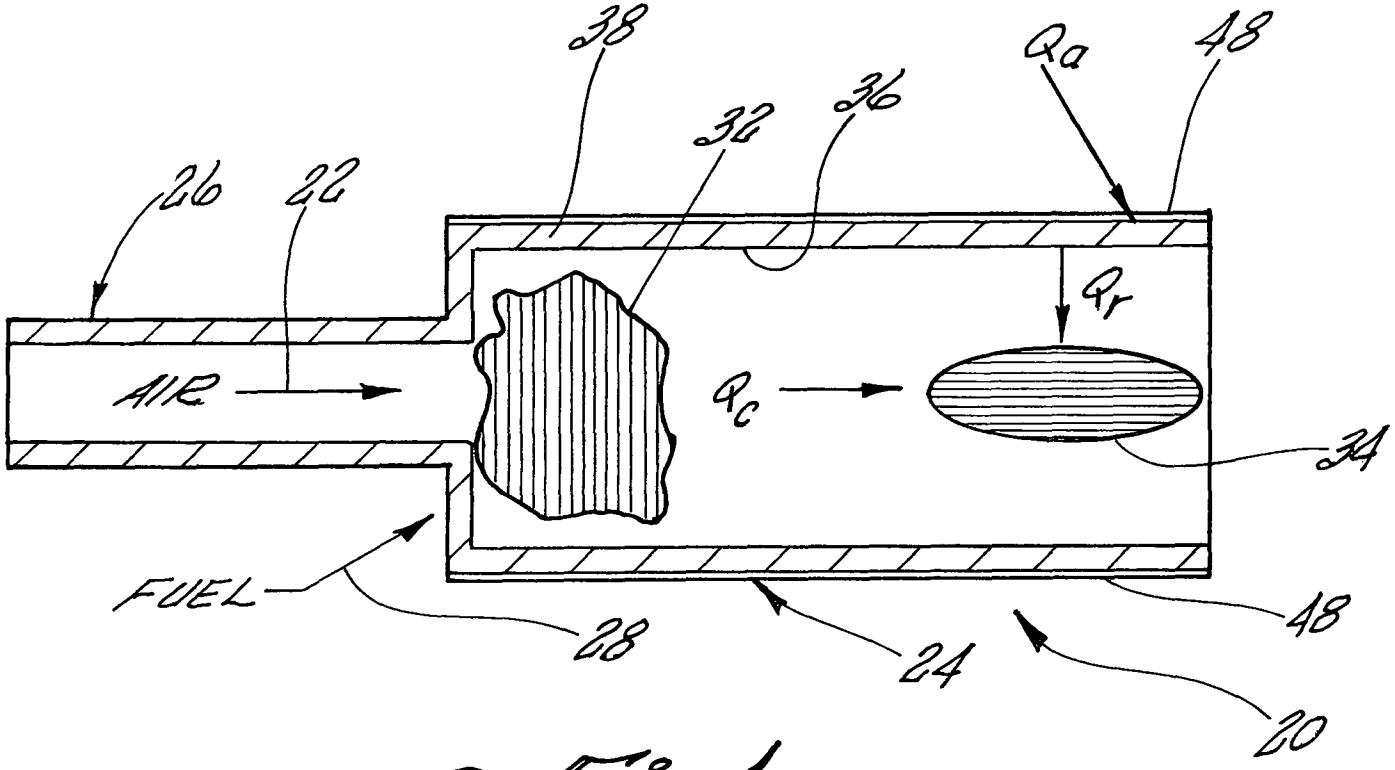
FIG. 1 is a schematic diagram of a combustion device which is used for an external fuel fire test for hazard classification.

Referring to FIG. 1, FIG. 1 illustrates the main elements of the combustion device 20 for providing a controlled heat flux environment. Combustion device 20 operates as a fast cook-off response device for insensitive munitions testing. Air, which is represented by arrow 22, enters the combustion chamber 24 via an air duct 26 at a flow rate which is determined by the required operating heat flux conditions. Fuel, which is represented by arrow 28, is injected at a location in the air duct 26, such that the fuel 28 can mix with the air 22 to provide a flammable mixture within combustion chamber 24. This mixture is then ignited in the combustion chamber 24 at which time the fuel is consumed in a reaction region 32 within combustion chamber 24, generating high-temperature gas products.

As shown in FIG. 1, the combustion chamber 24 has an inside diameter which is larger than the inside diameter of air duct 26. The change in area from the smaller air duct 26 to the larger combustion chamber 24 allows flame stabilization within the reaction region 32. The amount of fuel and air introduced into the combustion chamber 24 controls the gas temperature and therefore the heat flux within the combustion chamber 24.

The test article 34 contains energetic material for evaluation when subjected to a controlled heat flux. The heat flux is generated by two components in the combustion chamber 24. The first component of the heat flux is the convective high temperature gases $Q_c$ from the combustion products, while the second component of the heat flux is from radiation $Q_r$ generated from the high temperature wall inner surface 36 of combustion chamber 24. The wall surface 36 of the combustion chamber 24 is heated to the required temperature by the high temperature gases of the reaction region 32, or can be augmented by introducing additional heat $Q_a$ to certain areas of the combustor chamber wall 38.

The combustion device 20 comprising the present invention is intended to apply a uniform and constant heat flux level to a small-scale sample of a test article 34. The test article 34 contains energetic material so as to simulate the thermal penetration of heat flux experienced by a full-scale article in a hydrocarbon fuel fire. The combustion device 20 is controllable, tunable, and variable in its rate of heat flux application. Combustion device 20 has reusable and expendable sections and provides for a method of assessing the resulting damage due to fragmentation of the test specimen 34. Test specimen 34 may be a small scale rocket motor containing an energetic material.

Figure 2:
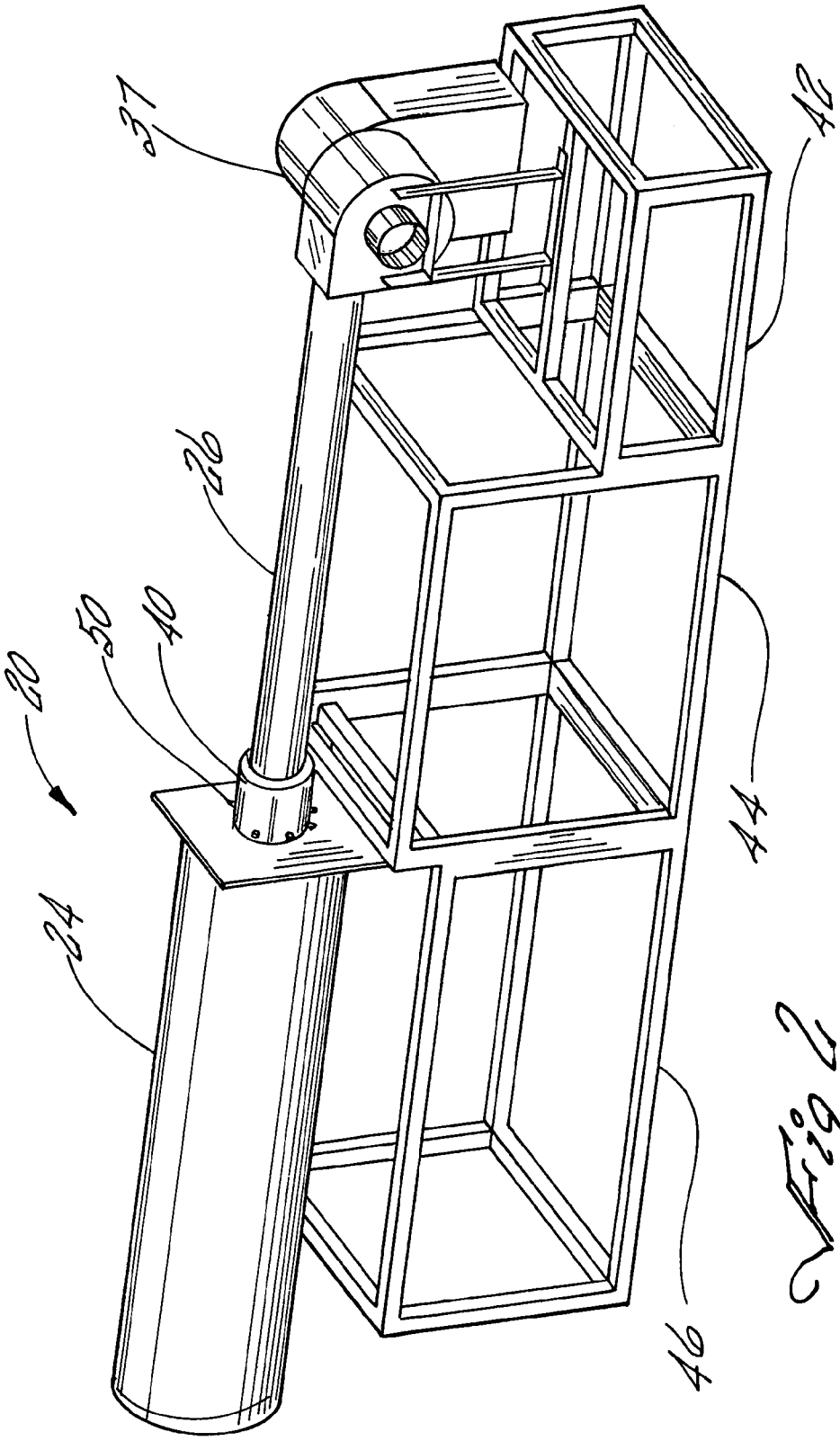
FIG. 2 is an isometric view of the combustion device and support structure comprising the present invention.

Referring to FIGS. 1 and 2, to supply the required heat flux of 100-200 kilowatts per square meter for the combustion device 20, chemical energy in the form of liquid propane is utilized as fuel 28 because of its high energy density and commercial availability. Propane also has the characteristic of self pressurization due to its high vapor pressure, eliminating additional hardware which would ordinarily be required for a fuel feed system. An additional system requirement for minimum complexity and support facilities led to the use of propane as the fuel source and electric motor powered fans encased within fan and motor housing 37 to provide the combustor air 22. Combustor device 20 also, required readily available and inexpensive parts that could be quickly assembled between test events should parts of the invention be consumed, damaged, or destroyed.

At this time, it should be noted that other liquid fuels which exhibit the same properties as liquid propane could be substituted for propane as the fuel used in the air propane flammable mixture of the present invention.

The combustion device 20 is to be used as a common diagnostic tool to assist in developing modeling codes using subscale energetic test articles, as an aide in the design and development of IM compliant systems to fast cook-off, and to be part of an alternate test protocol for external fuel-fire hazards classification test.

As shown in FIG. 2, combustion device 20 is a three piece modular set of components consisting of the air fan blower and motor 37 on the right, the air inlet duct 26 in the center, and the combustor chamber 24 which includes a fuel injection system/aluminum manifold 40 on the left. Each section of the combustion device 20 has its own support that is easily assembled and transported. The support cage for air fan blower and motor 37 is designated by the reference numeral 42, the support cage for air inlet duct 26 is designated by the reference numeral 44, and the support cage for combustion chamber 24 is designated by the reference numeral 46. Each support cage 42 and 44 and 46 is fabricated from rectangular shaped steel tubing which is welded together to from the cage structure of each support cage 42, 44 and 46.

The flammable mixture of propane fuel 28 and air 22 burns in the combustion chamber 24 of the combustion device 20. The result of the reaction in reaction region 32 is high-temperature gases that create a known heat flux based on the composition of the flammable mixture. The heat flux is controlled by a combination of the gas temperature and the total mass flow rate of the air 22 and propane fuel 28. While the convective component of the heat flux $Q_c$, is primarily controlled by the gas temperature, the radiation component $Q_r$, is interdependent on several conditions. The temperature within the surrounding combustion chamber 24 is controlled by the temperature of the contacting gases, the boundary layer at the wall surface 36, and insulation 48 on the outer-side of the chamber 24.

Along with the temperature of the chamber wall 38, the emissivity of the wall surface 36 has a large influence on the magnitude of $Q_r$. To better control the radiation component $Q_r$ of the heat flux, surface coatings are applied to the inner surface 36 of combustor chamber wall 38 to increase the emissivity on the combustor chamber wall 38 in the area surrounding the test article 34. A further increase and control of the radiation emitted can be accomplished by augmenting the wall surface temperature and by heat flux $Q_a$ addition. This will have a large influence on the total heat flux with only a moderate increase in wall temperature because graybody radiation is a function of the fourth power of temperature.

This temperature increase can be accomplished by injecting additional propane fuel 28 near the chamber wall 38 and allowing the flame to be in close proximity to the surface 36 of chamber wall 38. The chamber wall temperature only needs to be raised at the area surrounding the test article 34 for this to be effective.

The prototype for combustion chamber 20 was constructed and operated at various temperatures and mass flow rates which are calculated to be the required conditions. The non-expendable portion of the controlled heat flux combustor 20 is shown in FIG. 2. A five horsepower fan motor and fan within fan and motor housing 37 delivers air through a five inch (12.7 cm) diameter stainless steel schedule 5 air duct 26. The fan, when driven at 3870 RPM, delivers a mass flow rate of approximately 1 lb/sec (0.5 kg/sec). Propane fuel 28 is introduced into the combustion chamber 24 through an aluminum manifold 40 located at the end of the air duct 26 via eight equally space apart fuel injectors 50. As shown in FIG. 3B the eight fuel injectors are spaced apart by 45 degrees. An array of eight fuel injectors 50 was selected to provide uniform fuel distribution into the fluid chamber 24.

The propane fuel and air mixture expands into an 18 inch (0.46 m) diameter stainless steel combustion chamber 24. The non-expendable portion of the combustion chamber 24 is approximately 6 feet (2 meters) in length.

At this time it should that whenever the heat flux requirements are different the dimensions of combustion chamber 24 can be altered and the mass flow rate can be changed to accommodate the new heat flux requirements.

An additional 6 feet (2 meters) of combustion chamber could be added and would represent an expendable portion of the test apparatus and will act as a witness tube should fragmentation occur during the experiment.

Figure 3A:
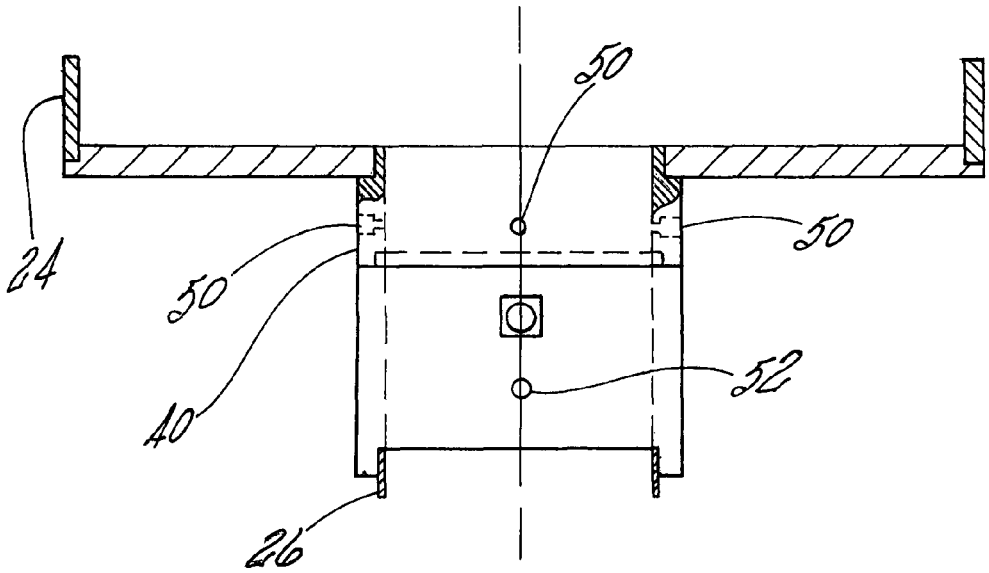
FIGS. 3A, 3B and 3C illustrate the fuel injection system/aluminum manifold used to inject propane fuel into the combustion chamber.
Figure 3B:
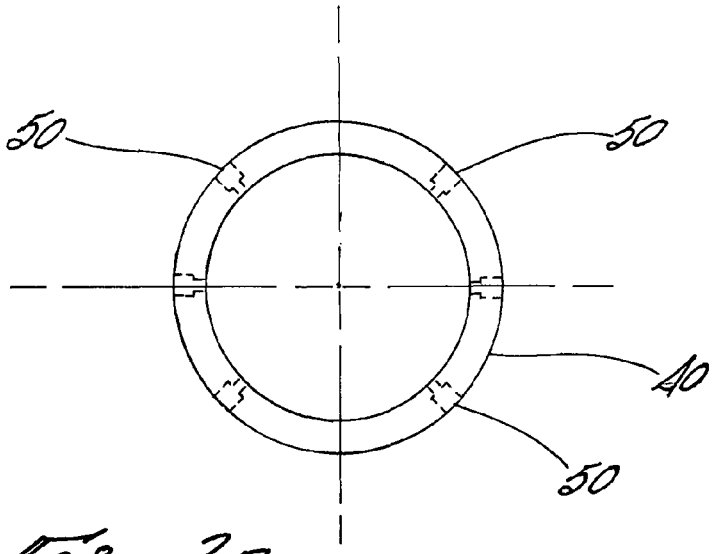
Figure 3C:
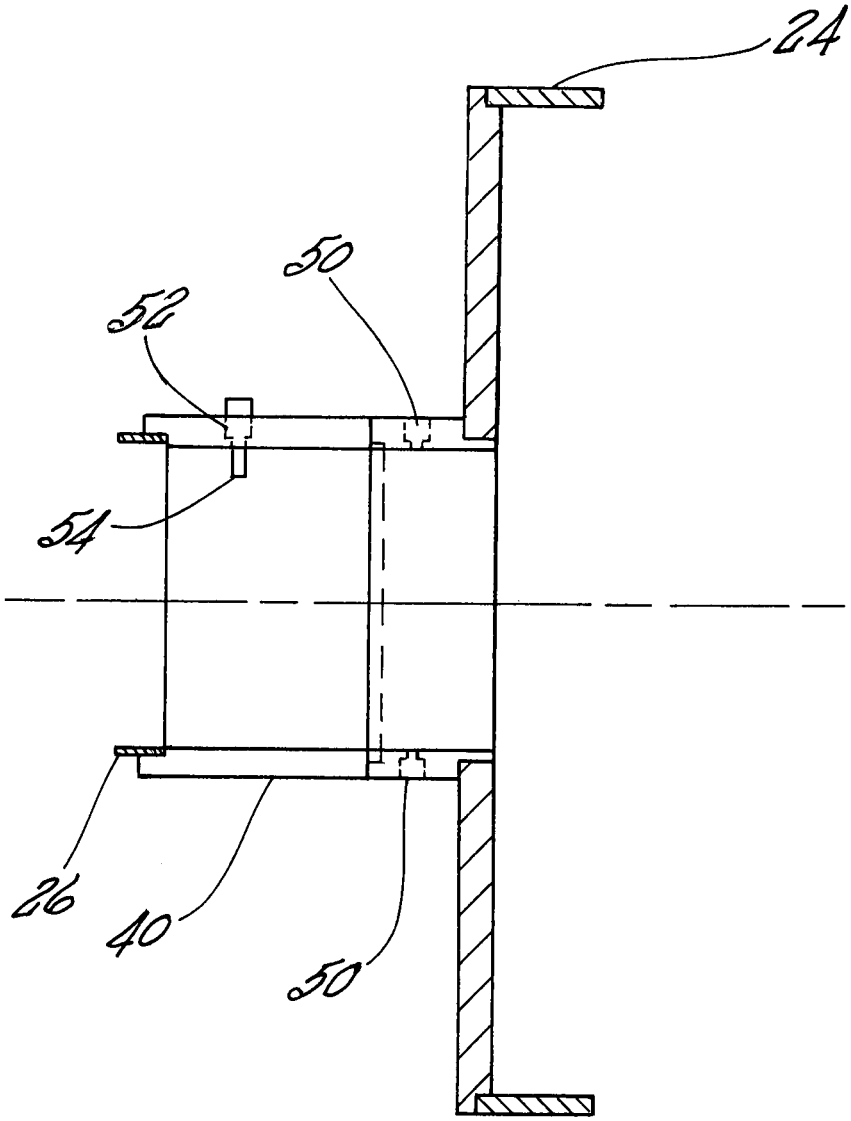

Referring to FIGS. 3A, 3B and 3C, as shown in FIG. 3B the eight fuel injectors 50 are equal spaced apart 45 degrees from each other. Three different injector openings were investigated for droplet concentrations and dispersion. The three injector openings tested were 0.1, 0.05 and 0.025 inch openings. The 0.05 inch opening for each injector 50 was chosen since this opening size would allow for adequate penetration of propane into the combustion chamber 24. The 0.1 inch opening did not allow propane to penetrate far enough into the chamber 24, while the 0.025 inch opening resulted too large of a penetration of propane into the chamber.

As shown in FIG. 3C, there is an opening 52 within manifold 40 which may include a sparkplug 54. The sparkplug 54, which extends into the interior of air duct 40, is used to ignite the propane fuel 28 entering combustion chamber 24.

Heat fluxes into devices submersed in pool fires generally range from 40 $kW/m^2$ (kilowatts/square meter) to 400 $kW/m^2$. Using this range of heat fluxes, calculations were performed to determine the feasibility of the controllable heat flux combustion device 20 comprising the present invention. The convective heat flux into a test article 34 was estimated using simple engineering analysis calculations. Bounding calculations were performed with various incoming gas temperatures ranging from 1000 degrees Kelvin to 1500 degrees Kelvin and velocities ranging from 7.6 meters/second to 91 meters/second. Heat fluxes of 16 $kW/m^2$ to 170 $kW/m^2$ were calculated over the design range criteria. These calculations confirmed the probability of the desired flux levels over a specified temperature span.

There is also a requirement for combustion device 20 to provide air with a relatively inexpensive fan and not use compressed air. The air mass flow rate needed is around 0.45 kg/s (kilograms per second) and not exceed 0.90 kg/s. This corresponded to a velocity upper limit of approximately 27 meters/second and provides a more realistic upper bound for the convective heat transfer of 65 $kW/m^2$. The calculated heat flux for combustion device 20 at the desired mass flow of 0.45 kg/s ranged from 20 $kW/m^2$ at 1000 degrees Kelvin air temperature to 38 $kW/m^2$ with an air temperature of 1500 degrees Kelvin.

Realizing that radiation is a major form of energy exchange in the combustion device 20, bounding radiation heat flux calculations into the test article 34 were also performed. Stainless steel was the material used for the outer wall cylinder 38 of the combustion chamber 24 and the air duct 26. The emissivity of hot stainless steel ranges from 0.5 to 0.8 depending on the level of oxidation. The emissivity of the test article 34 may have a similar range for metal cases or be higher for composite cases. Using the same temperature range for the outer wall as the hot incoming gas, which is 1000 degrees Kelvin to 1500 degrees Kelvin, a wall emissivity of 0.65 and an article emissivity of 0.8, the radiative heat flux was calculated to be from 30 $kW/m^2$ to 190 $kW/m^2$. In these calculations, using the low temperatures the contribution of radiation and convection to the heat flux into the test article 34 are similar. Since the radiative heat flux is a function of the wall temperature to the fourth power, the contribution of radiation to the incoming heat flux increased much faster than that of convection. When the upper temperature range is utilized, the radiative heat flux is calculated to be 5 times that of convection.

The initial heat flux calculations are important in that these calculations show that the combustion device 20 will deliver the desired heat flux to a test article 34. The calculations also show that there is considerable flexibility in the amount of control of the heat flux into a test article 34. To control the heat flux into the test article 34 requires the user to change or vary the incoming mass flow rate and the temperature.

What is claimed is:

1. A combustion apparatus for providing a controlled heat flux for testing a test specimen containing an energetic material comprising:

(a) a source of air for providing a stream of air at a fixed mass flow rate;

(b) an air inlet duct having said source of air positioned at one end thereof;

(c) a manifold positioned at the other end of said air inlet duct, said manifold having a fuel injection system comprising a plurality of equally spaced apart fuel injectors located within said manifold which form a ring around said manifold, wherein said plurality of fuel injectors of said fuel injection system inject a liquid fuel into said stream of air forming a flammable mixture;

(d) a combustion chamber having one end thereof connected to said manifold to receive said flammable mixture, said combustion chamber having an inside diameter that is larger than an inside diameter for said air inlet duct, wherein the inside diameter of said combustion chamber is eighteen inches and the inside diameter of said air inlet duct is approximately five inches; and (e) a fuel ignition device positioned in proximity to said flammable mixture, said fuel ignition device igniting said flammable mixture generating said controlled heat flux within said combustion chamber to test said test specimen which includes said energetic material.

2. The combustion apparatus of claim 1 wherein said source of air comprises a five horsepower fan motor and fan located within a fan and motor housing, said fan motor and fan delivering said stream of air through said air inlet duct at a mass flow rate of approximately one pound per second.

3. The combustion apparatus of claim 1 wherein said air inlet duct is fabricated from five inch diameter stainless steel and said combustion chamber is fabricated from eighteen inch diameter stainless steel.

4. The combustion apparatus of claim 1 further comprising a layer of insulation mounted on the outer side of said combustion chamber, said layer of insulation enhancing temperature control of said flammable mixture within said combustion chamber.

5. The combustion apparatus of claim 1 wherein said combustion chamber has an overall length of six feet.

6. The combustion apparatus of claim 1 wherein said controlled heat flux for said combustion apparatus at a mass flow rate of 0.45 kg/s ranges from 20 $kW/m^2$ at 1000 degrees Kelvin to 384 $kW/m^2$ at 1500 degrees Kelvin.

7. A combustion apparatus for providing a controlled heat flux for testing a test specimen containing an energetic material comprising:

(a) a source of air for providing a stream of air at a mass flow rate of 0.5 kg/sec, said source of air comprising a fan motor and fan, said fan, when driven at 3870 RPM, generating said mass flow rate of 0.5 kg/sec;

(b) an air inlet duct having said source of air positioned at one end thereof;

(c) a manifold positioned at the other end of said air inlet duct, said manifold having a fuel injection system comprising equally eight spaced apart fuel injectors located within said manifold which form a ring around said manifold, wherein the eight fuel injectors of said fuel injection system inject propane fuel into the stream of air forming a flammable mixture;

(d) a combustion chamber having one end thereof connected to said manifold to receive said flammable mixture, wherein said combustion chamber has an inside diameter that is larger than an inside diameter for said air let duct resulting in a substantial increase in area from said air inlet duct to said combustion chamber which allows for flame stabilization within a reaction region in said combustion chamber; and (e) a fuel ignition device positioned in proximity to said flammable mixture, said fuel ignition device igniting said flammable mixture generating said controlled heat flux within said combustion chamber to test said test specimen which includes said energetic material, wherein said controlled heat flux for said combustion apparatus at said mass flow rate of 0.5 kg/s ranges from 20 $kW/m^2$ at 1000 degrees Kelvin to 38 $kW/m^2$ at 1500 degrees Kelvin.

8. The combustion apparatus of claim 7 wherein the inside diameter of said combustion chamber is approximately eighteen inches and the inside diameter of said air inlet duct is approximately five inches.

9. The combustion apparatus of claim 7 wherein said combustion chamber and said air duct are each fabricated from stainless steel.

10. The combustion apparatus of claim 7 further comprising a layer of insulation mounted on the outer side of said combustion chamber, said layer of insulation enhancing temperature control of said flammable mixture within said combustion chamber.

11. The combustion apparatus of claim 7 wherein said combustion chamber has an overall length of approximately six feet.

12. A method for providing a controlled heat flux for testing a test specimen containing an energetic material comprising the steps of:

(a) generating a stream of air at a fixed mass flow rate;

(b) providing an inside diameter for a combustion chamber which is larger than an inside diameter for an air inlet duct resulting in a substantial increase in area from said air inlet duct to said combustion chamber which allows for flame stabilization within a reaction region in said combustion chamber;

(c) delivering said stream of air at said fixed mass flow rate through said air inlet duct to said combustion chamber;

(d) injecting propane fuel into said stream of air at a location in proximity to said combustion chamber to form a flammable mixture for said combustion chamber; and (e) igniting said flammable mixture when said flammable mixture is within said combustion chamber, said flammable mixture when ignited within said combustion chamber generating a controllable heat flux for testing said specimen containing said energetic material.

13. The method of claim 12 further comprising the step of providing a manifold which includes eight equally spaced apart nozzles forming a ring around said manifold, wherein said manifold is positioned in proximity to said combustion chamber which allows the eight nozzles within said manifold to inject said propane fuel into said stream of air forming said flammable mixture within said combustion chamber.

14. The method of claim 12 wherein said fixed mass flow rate is approximately 0.5 kg/sec.

15. The method of claim 14 further comprising the step of providing a source of air positioned at end of said air duct opposite said combustion chamber, wherein said source of air comprises a five horsepower fan motor and fan located within a fan and motor housing, said fan motor and fan delivering said stream of air through said air inlet duct at said fixed mass flow rate of 0.5 kg/sec.

16. The method of claim 12 further comprising the step of providing a layer of insulation mounted on the outer side of said combustion chamber, said layer of insulation enhancing temperature control of said flammable mixture within said combustion chamber.

17. The method of claim 12 further comprising the step of providing said controlled heat flux for said combustion apparatus at a mass flow rate of 0.45 kg/s which ranges from 20 $kW/m^2$ at 1000 degrees Kelvin to 38 $kW/m^2$ at 1500 degrees Kelvin.

* * * * *